US005374006A

United States Patent [19]

Mheidle

[11] Patent Number: 5,374,006

[45] Date of Patent: Dec. 20, 1994

[54] METHOD AND APPARATUS FOR WINDING SUBSTRATES THAT ARE CAPABLE OF BEING WOUND

[75] Inventor: Mickael Mheidle, Sausheim, France

[73] Assignee: Ciba-Geigy Corporation, Ardsley, N.Y.

[21] Appl. No.: 21,696

[22] Filed: Feb. 24, 1993

[30] Foreign Application Priority Data

Mar. 4, 1992 [DE] Germany ..... 92810166

[51] Int. Cl.[5] ..... B65H 19/26; B65H 19/28; B65H 19/29

[52] U.S. Cl. ..... 242/413.1; 242/527.7; 242/532.4; 242/534.2; 242/538; 242/580; 242/535

[58] Field of Search ..... 242/56 R, 56 A, 67.3 R, 242/67.5, 57, 75.51, 75.52, 58, 67.2, 527.7, 413.1, 532.4, 532.7, 534.2, 538, 560, 580, 535

[56] References Cited

U.S. PATENT DOCUMENTS

| | | | |
|---|---|---|---|
| 3,061,228 | 10/1962 | Andrade | 242/75.51 |
| 3,223,906 | 12/1965 | Dinger | 242/75.51 |
| 3,638,873 | 2/1972 | Cole | 242/75.51 |
| 3,780,961 | 12/1973 | Kahwati et al. | 242/75.51 X |
| 3,782,664 | 1/1974 | Alberto | 242/56 R |
| 4,116,398 | 9/1978 | Roberts | 242/56 R |
| 4,508,284 | 4/1985 | Kataoka | 242/75.51 |
| 4,523,725 | 6/1985 | Futagawa | 242/67.3 R |
| 4,919,352 | 4/1990 | Terp et al. | 242/56 A |
| 5,040,737 | 8/1991 | Zeroni et al. | 242/56 A |
| 5,042,736 | 8/1991 | Nomura et al. | 242/56 R |

FOREIGN PATENT DOCUMENTS

| | | |
|---|---|---|
| 0202591 | 11/1986 | European Pat. Off. . |
| 0289607 | 4/1914 | Germany . |
| 2057492 | 6/1972 | Germany . |
| 3543878 | 3/1986 | Germany . |

*Primary Examiner*—John M. Jillions
*Attorney, Agent, or Firm*—William A. Teoli, Jr.; Marla J. Mathias

[57] ABSTRACT

A substrate capable of being wound is transported to a substrate carrier and wound onto the latter. For that purpose the substrate is first held in a defined storage position. With the substrate in that storage position the substrate carrier is moved into a threading position and brought into engagement with the substrate. The substrate is then automatically threaded around the substrate carrier. When the threading operation is complete, the substrate carrier is moved into a winding position in which the substrate is wound onto the substrate carrier. The rate of feed at which the substrate is transported by a motor to the substrate carrier is regulatable. The substrate carrier is motor-driven in a controllable manner, at a uniform torque and in dependence on the feed rate at which the substrate is transported to the substrate carrier. When the winding operation is complete the substrate is cut and the end of the substrate belonging to the winding is automatically fixed to the winding, while the other end of the substrate is again held in the defined storage position.

13 Claims, 12 Drawing Sheets

METHOD AND APPARATUS FOR WINDING SUBSTRATES THAT ARE CAPABLE OF BEING WOUND

Figure 1:
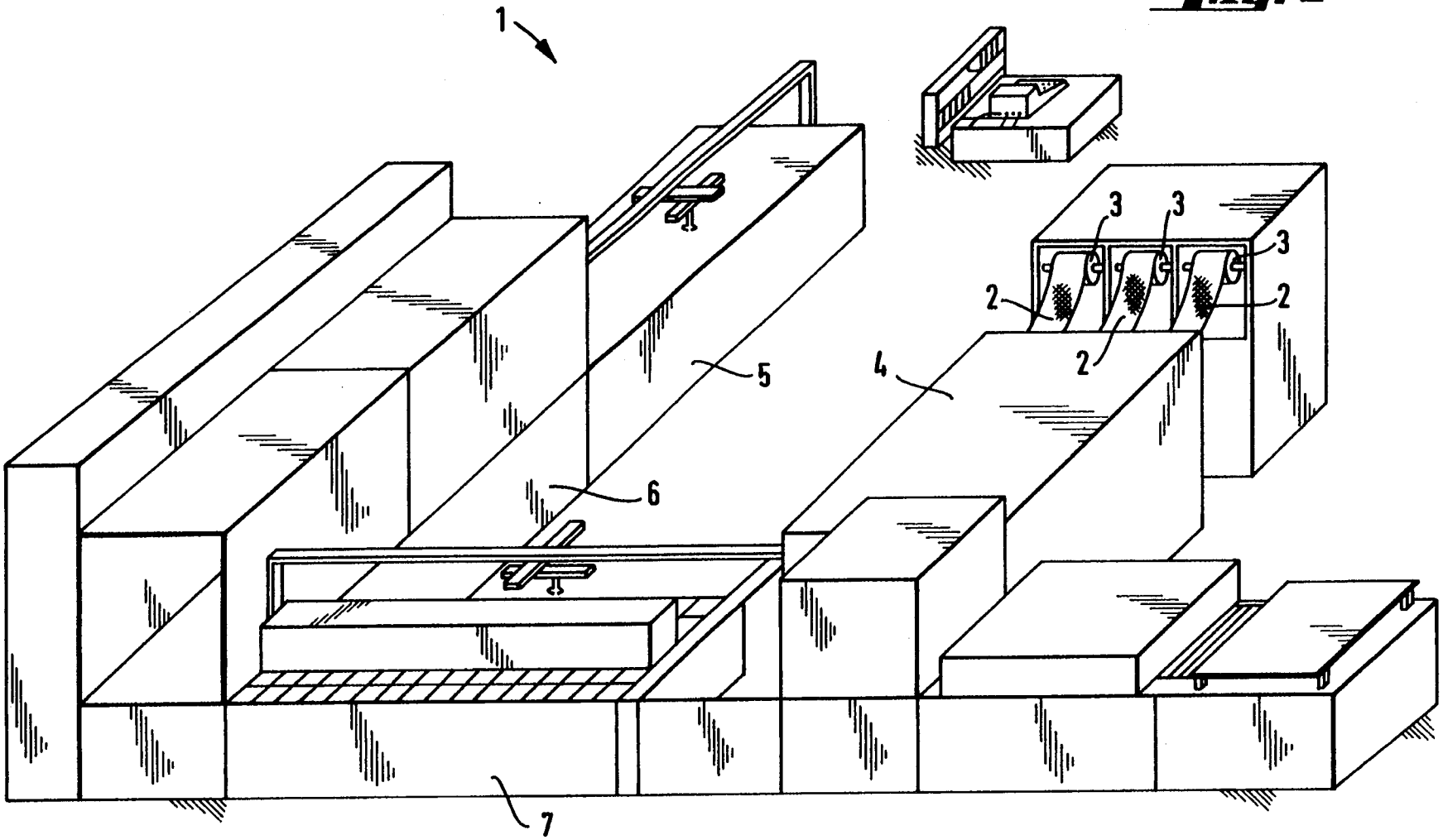

The invention relates to a method and an apparatus for winding substrates that are capable of being wound, in accordance with the preamble of the respective independent patent claim.

There is a great deal of interest in the dyestuff-producing industry as well as on the part of the dyestuff-processing industry in testing the dyestuffs used before they are used industrially (in production), in order to be able to optimise the conditions under which they are applied, to match colour shades and to compare and monitor various products from an economical and a technical point of view. In particular in the area of textile dyeing, i.e. the dyeing of materials or fabrics, it is often necessary to carry out extensive series of tests in order to determine the most suitable conditions for the desired textile/dyestuff combination or to determine the most suitable dyestuff and/or to match the desired colour shade. For that purpose, a large number of test dyeings (sample dyeings) are carried out in the laboratory and adapted to suit the future industrial conditions. For that purpose, for example, a specific amount of a material (substrate) to be test-dyed is wound onto a so-called sample-dyeing sleeve. The sleeve, together with the material wound onto it, is exposed to a dye bath. The wall of the sleeve contains a large number of openings, with the result that all of the wound material is penetrated by the circulating dyeing fluid in the dye bath.

As already mentioned, the aim is to use those sample dyeings to obtain a reliable indication of the conditions that are suitable for the desired textile/dyestuff combination and/or of how the dyestuff used behaves under production conditions, i.e. to discover which dyestuff is most suitable and/or with which dyestuff the desired colour shade is best obtained. In order to obtain reliable information, however, it must be ensured that the material to be dyed that is wound onto the sleeve is always wound on under uniform tension, as under production conditions.

The winding of the materials to be dyed onto the sample-dyeing sleeve in the laboratory has hitherto been effected for example as follows: first of all the material to be wound, or the end of the material, is pulled manually from a substrate-storage reel and the strip of material that has been pulled from the reel is threaded manually, i.e. the end of the material is secured to the sample-dyeing sleeve. The sample-dyeing sleeve is then rotated using a hand-operated crank and the threaded material is wound onto the sleeve, i.e. around the sleeve. When the winding is finished, the material is cut, for example using scissors, and the end of the material belonging to the winding is secured (for example stapled) to the winding. The winding effected by that method is, however, uneven, i.e. the thickness of the individual layers of material to be dyed that are wound around the sleeve can vary greatly. Above all, however, with manual operation there can be great variation in the tension under which the material to be dyed is wound onto the sleeve, with the result that the areas of the material that have been wound on under higher tension are very greatly stretched, whereas the areas that have been wound on under lower tension are stretched to a lesser extent. Owing to that uneven winding of the material onto the sleeve the perceived colour obtained after the subsequent dyeing of the material can vary very widely, since areas that have been stretched to different extents when wound onto the sleeve are naturally penetrated to different extents by the dyeing fluid in the dye bath during the subsequent dyeing operation. Under those circumstances it is virtually impossible to obtain a reliable indication of what the perceived colour of the dyed material will be later under production conditions.

Furthermore, that unevenness in winding also causes very considerable variations in the wound-on mass of substrate, which makes it considerably more difficult to assess what the perceived colour will be later under production conditions. Moreover, in the case of known laboratory winding apparatus, after a winding operation the substrate has to be cut each time by hand and the cut-off end secured to the winding. Before the start of a new winding operation, the other end of the strip of material then has to be threaded anew before a new winding operation can begin. A further disadvantage of such known laboratory apparatus is its low working speed.

One problem underlying the invention is therefore to provide a winding method and a winding apparatus in which those disadvantages have been eliminated, i.e. which makes it possible especially for the individual layers of a substrate to be wound on to be of uniform thickness and, above all, ensures that the individual layers are wound onto the substrate carrier under uniform tension. Only when the tension of the wound-on substrate is uniform can the penetration of the individual layers of the substrate during the subsequent dyeing also be as uniform as possible and the perceived colour that will be obtained under production conditions can thus be reliably assessed and/or recipes for dyestuffs for obtaining a specific perceived colour can thus be determined. In addition, it is desirable to make possible automatic threading, winding, cutting and fixing of the end of the substrate, in order to keep expenditure on the operation of such apparatus low and to reduce the time required for the threading, winding, cutting and fixing, thus increasing efficiency.

Those and other disadvantages of the prior art are eliminated and, especially, the problem is solved as regards the method as follows: the substrate to be wound is first held in a defined storage position and then the substrate carrier is moved into a threading position in which the substrate is brought into engagement with the substrate carrier. The substrate to be wound is then automatically threaded around the substrate carrier and when the threading operation is complete the substrate carrier is moved into a winding position. In that winding position the substrate is wound around the substrate carrier, the substrate being transported to the substrate carrier by being driven at a controllable rate of feed by a motor. The substrate carrier itself is motor-driven in a controllable manner at a uniform torque and in dependence on the feed rate at which the substrate is being transported to the substrate carrier. When the winding operation is complete, the substrate is cut and the end of the substrate belonging to the winding around the substrate carrier is automatically fixed to the winding, while the other end of the substrate is again held in the defined storage position. In that manner the substrate is wound onto the substrate carrier under uniform, reproducible tension. As a result, when dyeing textile samples, as explained in the introduction, it is possible to obtain a reliable indication of the perceived colour that will be obtained later under production conditions when dyeing with a dyestuff of a specific recipe and/or in that manner to determine the recipe required to achieve a specific perceived colour. At the same time, automatic threading, winding, cutting and fixing are made possible and hence the efficiency of the winding operation is increased.

In a variant of the method of the invention, the motor drive for transporting the substrate to the substrate carrier is regulated to a uniform feed rate. As a result the effort required to control the drive for the substrate carrier, which is, of come, controlled in dependence on the feed rate, is kept low, since when the transport drive is regulated to a uniform feed rate the feed rate is subject to slighter variations and therefore correspondingly smaller adjustments have to be made to the control signals.

In a further variant of the method, first of all for a known substrate width and a known substrate thickness the mass per unit area of the substrate to be wound on is determined and then the desired mass of substrate to be wound onto the substrate carrier is specified. On the basis of the determined mass per unit area of the substrate and the specified desired mass of substrate to be wound on, corresponding signals for controlling and/or regulating the motor drives are then generated. As a result, in the case of substrates of known width, the mass per unit area of which is, however, unknown, it is now possible for the first time to determine the mass per unit area, which is necessary in order to be able to wind a desired (total) mass of substrate onto the substrate carrier. On the other hand, this ability to determine the mass per unit area of the substrate is also advantageous in the case of substrates of which the mass per unit area is known as a standard value, since even with such standard substrates it is possible for there to be departures from the standard value, and with the aid of this variant a simple "calibration" is possible.

The mass per unit area can advantageously be determined as follows: first of all the weight of the empty substrate carrier—which is of known diameter—is determined. Then substrate is wound onto the substrate carrier until a predetermined diameter of the laden substrate carrier is reached. The weight of the laden substrate carrier is then determined. If the substrate width and the substrate thickness are known, then on the basis of all those values the mass per unit area of the substrate can be determined. If the substrate thickness is known, then for a desired mass of substrate to be wound onto the substrate carrier the diameter of the laden substrate carrier can be determined in advance and monitored, so that when the pre-calculated diameter of the laden substrate carrier is reached the winding operation is stopped.

In a further advantageous variant of the method the desired tension under which the substrate is to be wound onto the substrate carrier and the desired duration of the winding operation are specified. In a case where the specified values are compatible with the substrate to be wound, signals for controlling and/or regulating the motor drives are generated on the basis of those values. The advantages of this variant lie in the fact that different substrates can be wound on under different tensions, since not all substrates are capable of withstanding the same amount of tension, and tearing (where the tension is too high) or creasing (where the tension is too low) of the substrate must be avoided. For that purpose a corresponding warning can be given, for example can appear on a screen, to the effect that the selected parameters are not compatible with the substrate to be wound on. The same applies to the duration of the winding operation and/or the rate at which the substrates are wound on: different substrates can or must be wound on at different maximum rates.

In a further variant of the method a number of substrates are made ready (for example in the form of a magazine) and as the first step (i.e. before any "calibration") the desired substrate is first selected from or identified among that group of substrates. Using this variant of the method, laborious manual exchange of the readied substrate, for example a substrate-storage reel, is avoided. In this case, once the desired substrate has been input, the selection of the substrate is fully automatic, with the result that this variant of the method is distinguished by its efficiency.

As regards the apparatus, the disadvantages of the prior art are eliminated and, especially, the problem of the invention is solved by the provision of retaining means for holding the substrate in a defined storage position and means for moving the substrate carrier into a threading position in which the substrate carrier engages the substrate to be threaded that is held in the defined storage position and threads it around the substrate carrier. Also provided are means for moving the substrate carrier that, after the threading of the substrate, move the substrate carrier into a winding position in which the means for winding the substrate wind the threaded substrate onto the substrate carrier. The means for winding the readied substrate comprise a motor-driven transport drive provided with means for regulating the feed rate at which the transport drive transports the substrate guided between draw rollers to the substrate carrier. The means for winding the substrate also include a motor-driven drive for the substrate carrier which is provided with control means that transport it in dependence on the feed rate at which the transport drive is transporting the substrate to the substrate carrier and that drive the substrate carrier at a uniform torque. Also provided are both means for cutting the wound-on substrate after completion of the winding operation and means for automatically fixing to the winding the end of the substrate belonging to the winding, while the retaining means hold the other end of the substrate in the defined storage position again. Using such an apparatus the substrate is wound onto the substrate carrier under a uniform, reproducible tension. As a result, when dyeing textile samples, as mentioned at the beginning, it is possible to obtain a reliable indication of the perceived colour that will be obtained when dyeing is carried out later under production conditions with a dyestuff of a specific recipe, and/or in this way to determine the recipe required to achieve a specific perceived colour. At the same time automatic threading, winding, cutting and fixing are made possible and hence the efficiency of the winding operation is increased.

In an advantageous embodiment of the apparatus, the regulating means for the transport drive regulate the feed rate of the substrate to a uniform rate. As a result the effort required to control the drive for the substrate carrier, which is, of course, controlled in dependence on the feed rate, is kept low, since when the transport drive is regulated to a uniform feed rate the feed rate is subject to slighter variations and hence correspondingly smaller adjustments have to be made to the control signals.

In an embodiment of the apparatus the retaining means for holding the substrate in the defined storage position comprise a retaining rail or a retaining element having a retaining surface, facing the substrate carrier when it has been moved into the threading position, that has suction openings and a reduced pressure connection that is connected via a valve to a source of reduced pressure. As the substrate is threaded on, the retaining element is connected in pressure to the reduced pressure source, with the result that it generates reduced pressure through the suction openings in the retaining surface and draws the substrate against the retaining surface by means of suction. On its outer wall the substrate carrier has several regions about its longitudinal axis in which needles projecting substantially radially outwards from its outer wall are provided. Those needles engage the substrate held in the storage position. Corresponding grooves for those needles on the substrate carrier have been made in the retaining surface of the retaining element, so that the substrate carrier can be driven (rotated) without hindrance. When the threading is complete, the valve cuts off the reduced pressure source from the retaining element in pressure, thus releasing the substrate from the retaining surface and allowing it to be wound on. This embodiment of the apparatus allows simple and reliable automatic threading of the substrate and is therefore especially efficient.

In an advantageous development of the apparatus the cutting means, seen in the transport direction of the substrate, are arranged immediately downstream of the retaining element. With this arrangement, when the substrate has been cut the end of the substrate that does not belong to the winding can be held by the retaining element, with the aid of the reduced pressure some, in the manner already explained, and the threading of the substrate onto the next substrate carrier can likewise be effected automatically in the simple and reliable manner already described.

In a further embodiment of the apparatus according to the invention, the means that fix to the winding the end of the substrate belonging to the winding comprise a ring that is provided on the individual substrate carrier coaxially with the longitudinal axis of the substrate carrier, in the region of the end of the substrate carrier. The inner surface of this ring is provided with a circumferential groove in which the substrate carrier can rotate freely during winding. Provided on the outside of the ring and arranged substantially perpendicular to the longitudinal sectional plane through the substrate carrier is a pin around which actuatable fixing spikes are mounted so as to pivot between two positions. As the substrate is wound onto the substrate carrier the spikes are pivoted outwards into a winding position in which they do not inhibit the winding of the substrate onto the substrate carrier. In a fixing position, on the other hand, they are pivoted inwards substantially into the longitudinal direction of the substrate carrier and pierce at least the outer two layers of wound-on substrate and thus fix them together. This embodiment of the apparatus allows simple automatic fixing to the winding of the end of the substrate belonging to the winding. At the same time the substrate can be threaded and wound on in the manner already described.

In a development of that embodiment, separate actuating members are provided which pivot the fixing spikes outwards into the winding position before the threading operation starts and pivot the fixing spikes inwards into the fixing position at the end of the winding operation.

In a further embodiment of the apparatus, means are provided for determining the mass per unit area of the substrate, the substrate width and the substrate thickness being known. Also provided are input means for specifying the desired mass of substrate to be wound onto the substrate carrier and calculating means that, on the basis of the determined mass per unit area of the substrate and the desired mass to be wound on, generate corresponding signals for the control means for the drive of the substrate carrier and/or for the regulating means for the transport drive and pass the signals on to them. This embodiment allows "calibration" and thus makes it possible for a desired mass of substrate to be wound onto a substrate carrier.

In a development of that apparatus, weighing means for determining the weight of the substrate carrier when empty and when laden are provided for determining the mass per unit area. Also provided are means for monitoring the diameter of the laden substrate carrier, which means stop the winding operation when the diameter of the laden substrate carrier has reached a predetermined diameter. Then, where the diameter of the empty substrate carrier is known, the calculating means use those values to calculate the mass per unit area of the substrate. On the basis of the desired mass of substrate to be wound on, the calculating means calculate the diameter of the laden substrate carrier in advance and so position the means for monitoring the diameter of the laden substrate carrier that when the pre-calculated diameter is reached they detect it and thus stop the winding operation.

In a development of the apparatus, input means are provided for specifying the desired mass of substrate to be wound onto the substrate carrier, for specifying the desired tension of the substrate on the substrate carrier and for specifying the duration of a winding operation. Electronic calculating means calculate and, where the specified values are compatible with the substrate to be wound on, generate on the basis of those values corresponding control signals for the drive motors and/or their control or regulating means. Where for a specific substrate an inadmissible parameter has been input (for example a tension that is too high and that is incompatible with the substrate), the electronic calculating means are able to recognise this and inform the user.

An especially advantageous embodiment of the apparatus according to the invention comprises a plurality of substrate-storage reels, there being provided for each storage reel a separate motor-driven pair of draw rollers clamped between which the substrate is guided. Also provided in this embodiment are input means for specifying the desired substrate to be wound onto the substrate carrier. On the basis of the desired substrate specified, the motor transport drive moves towards the draw rollers of the substrate selected via the input means or towards the corresponding substrate-storage reel and couples the drive to the draw rollers of the selected substrate. This embodiment operates substantially fully automatically, especially when the afore-mentioned other components for the automatic threading, winding, cutting and fixing of the substrate are provided, and is thus very especially efficient.

Figure 2:
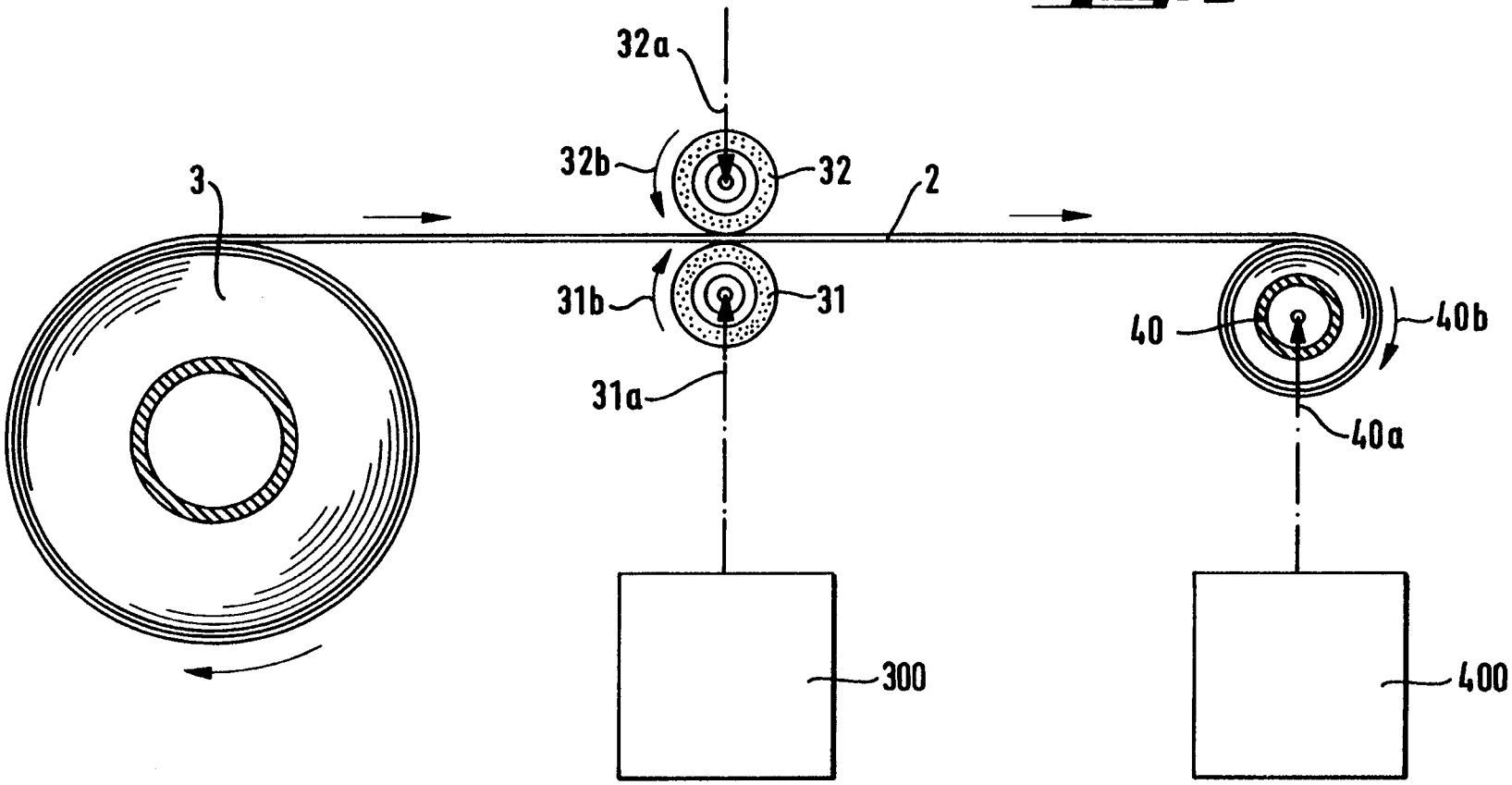
Figure 3:
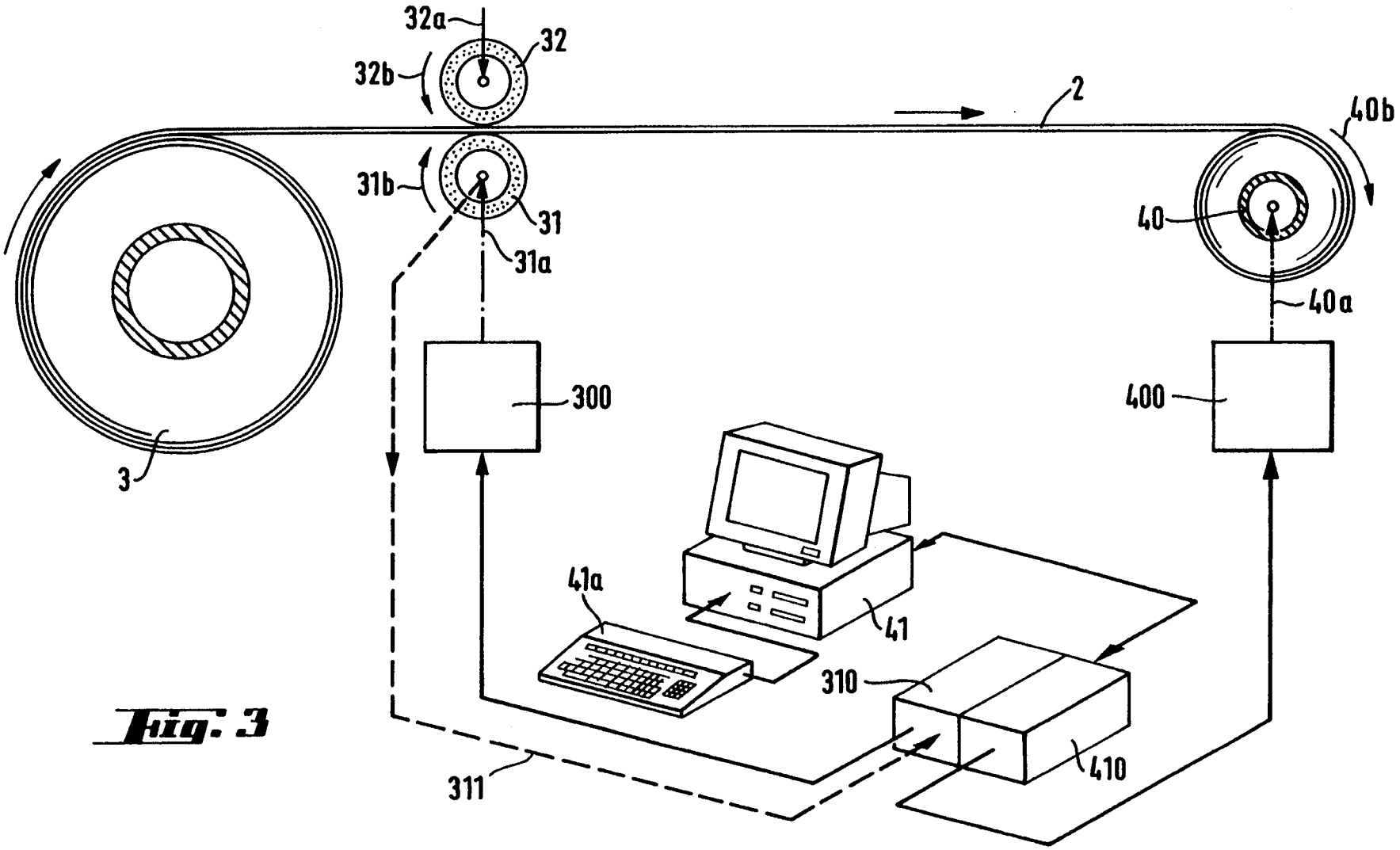
Figure 4:
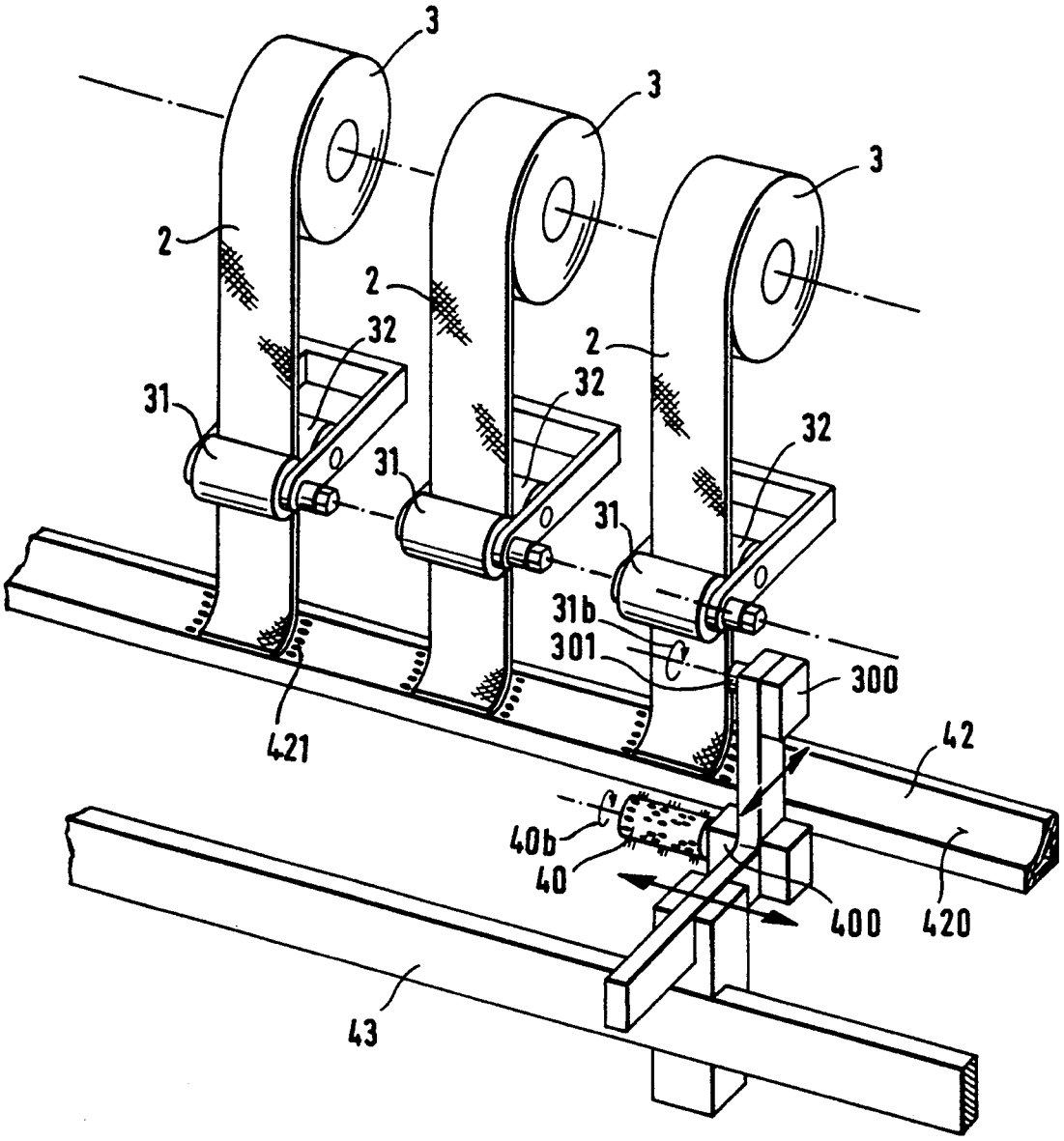
Figure 5:
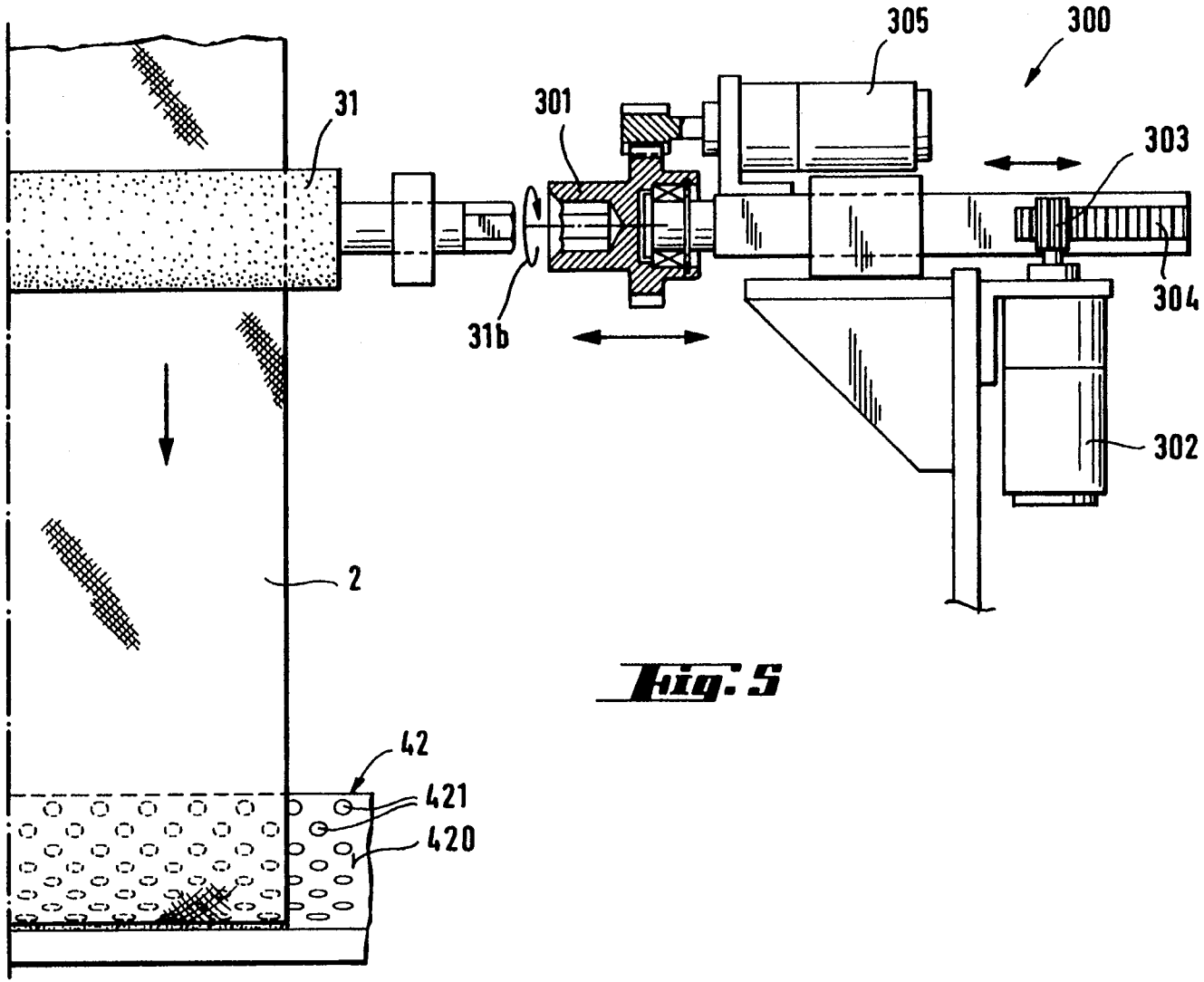
Figure 6:
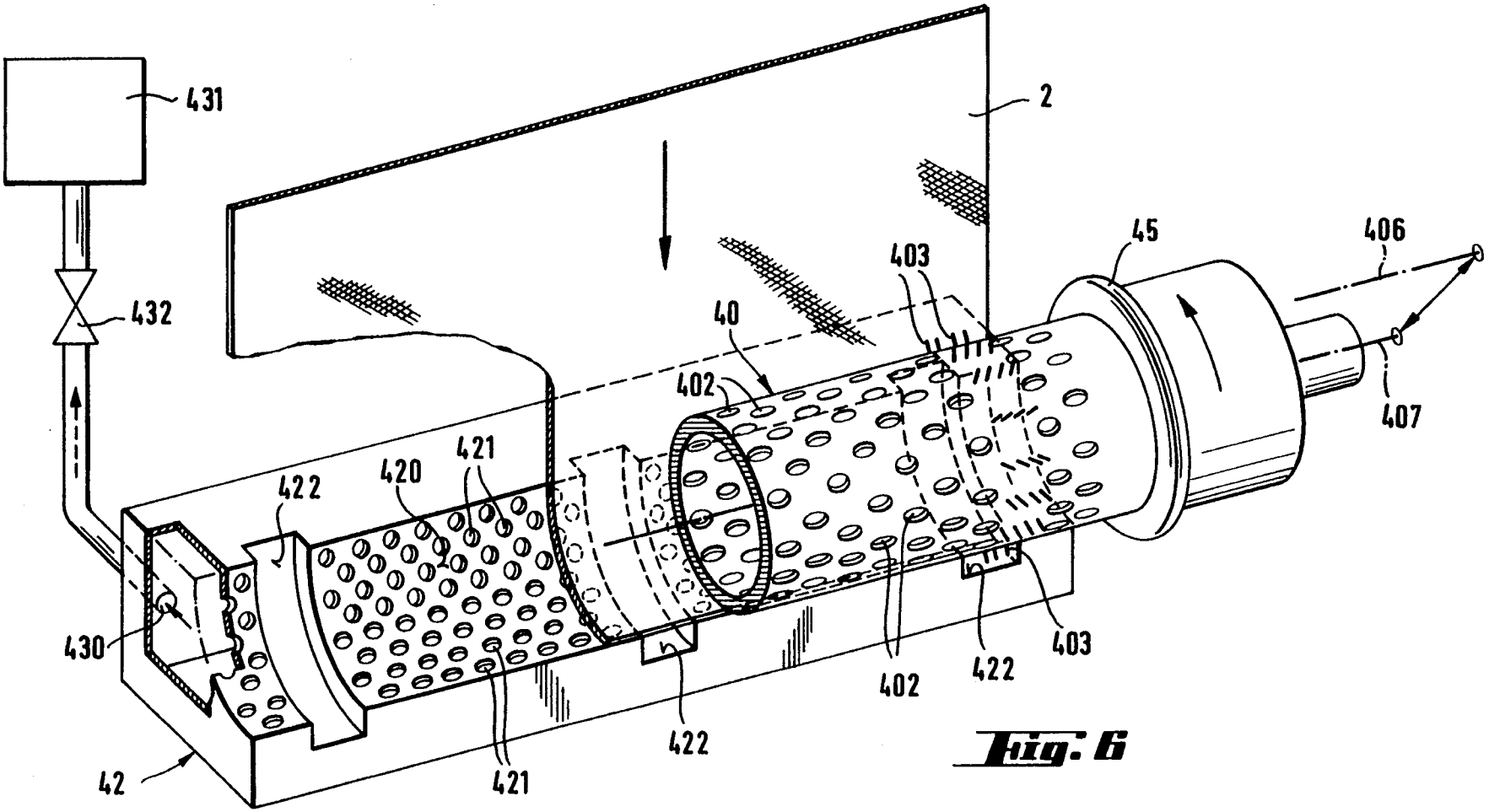
Figure 7:
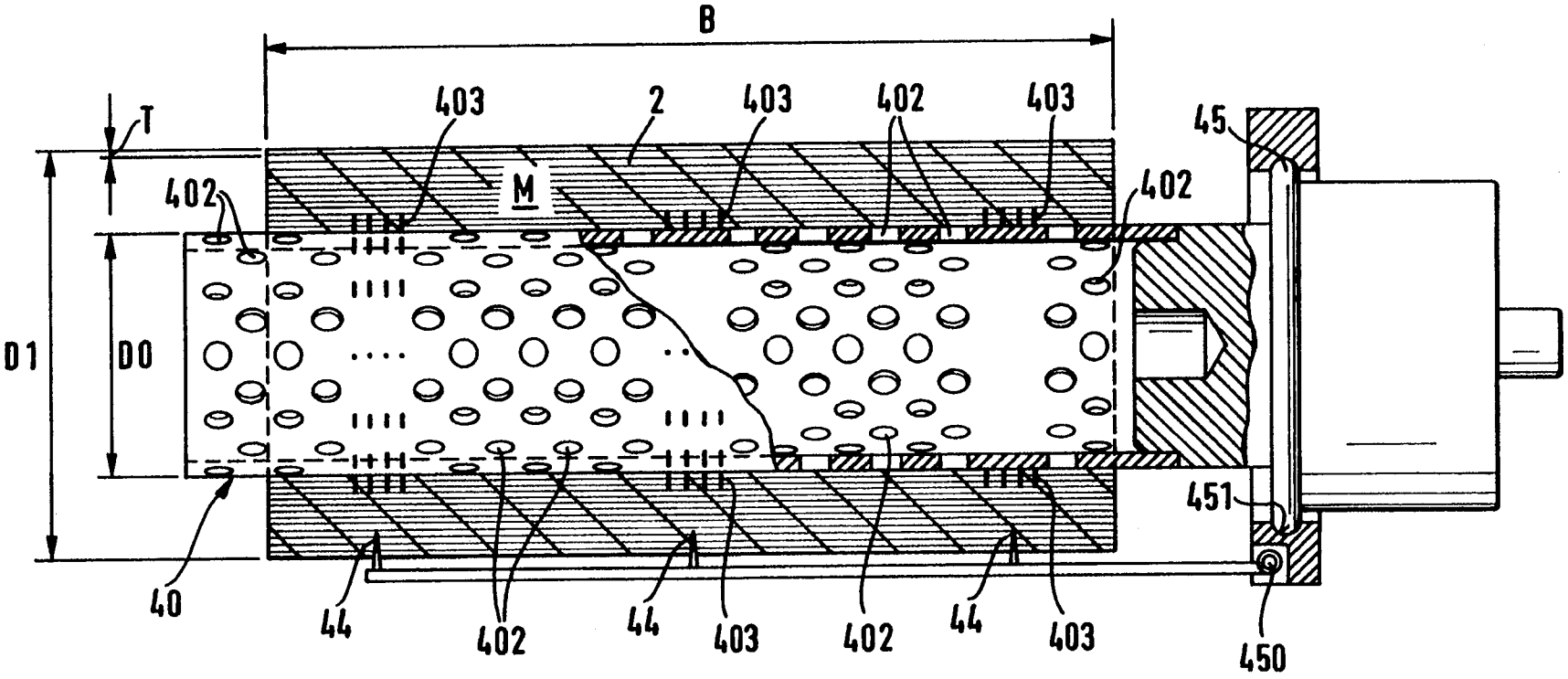
Figure 8:
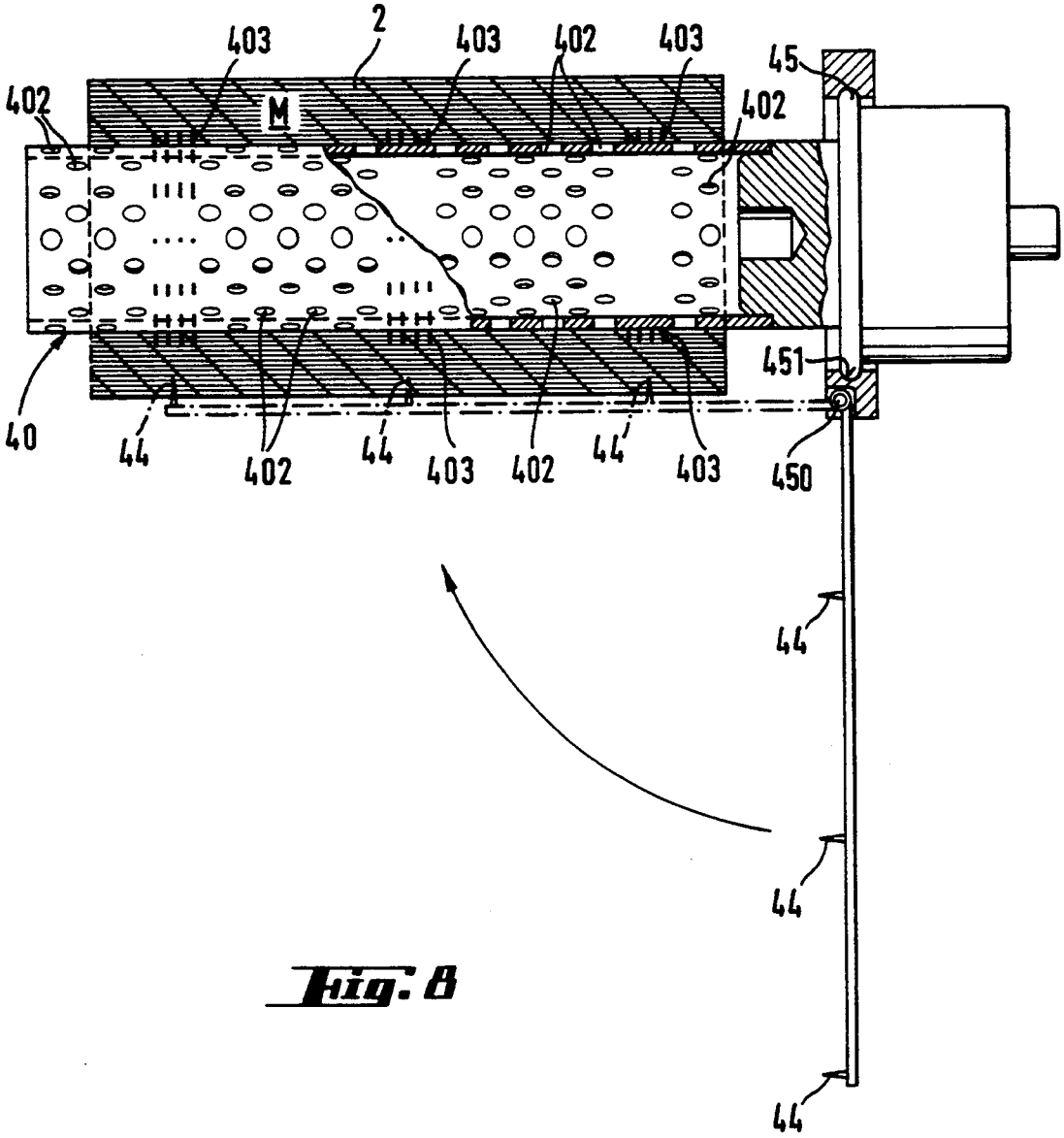
Figure 9:
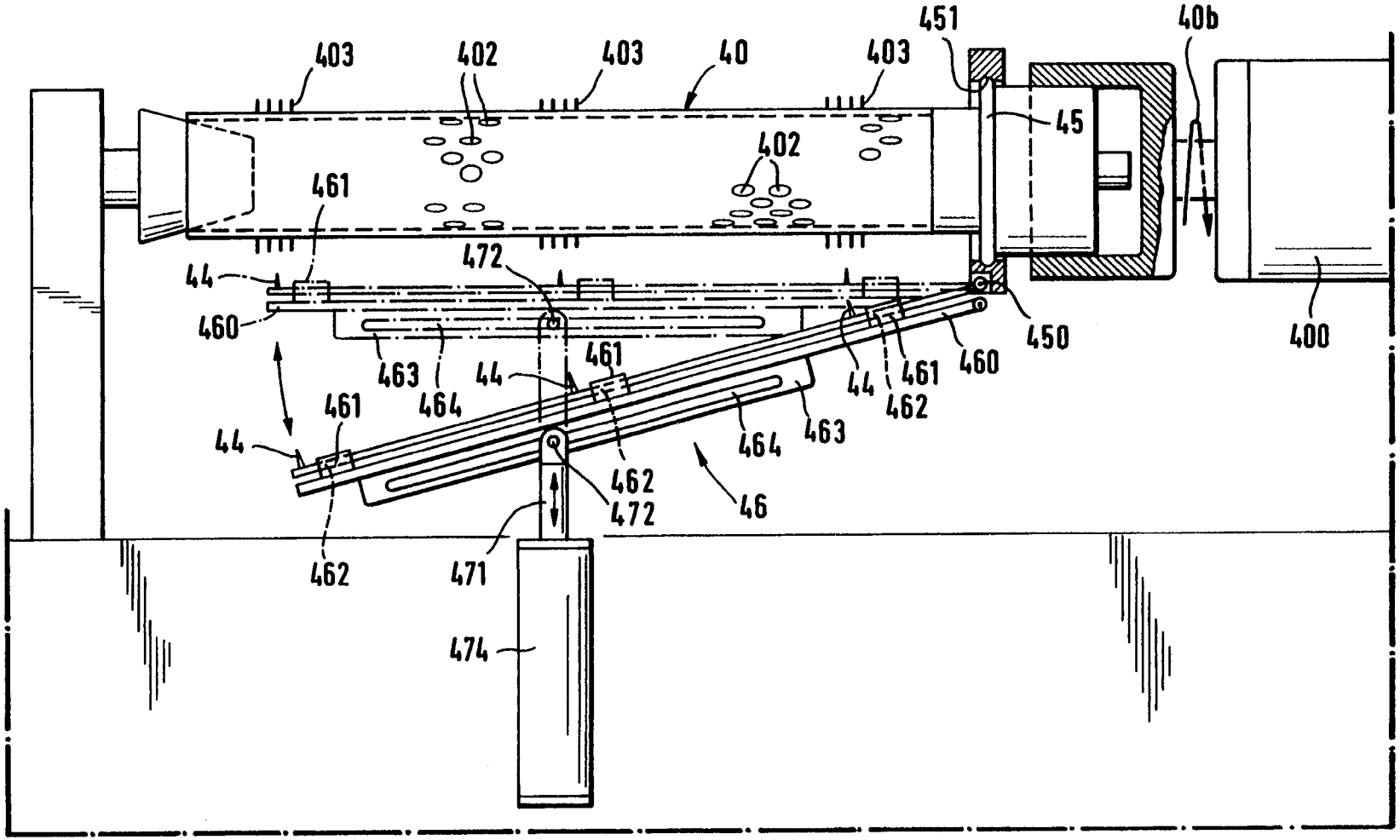
Figure 10:
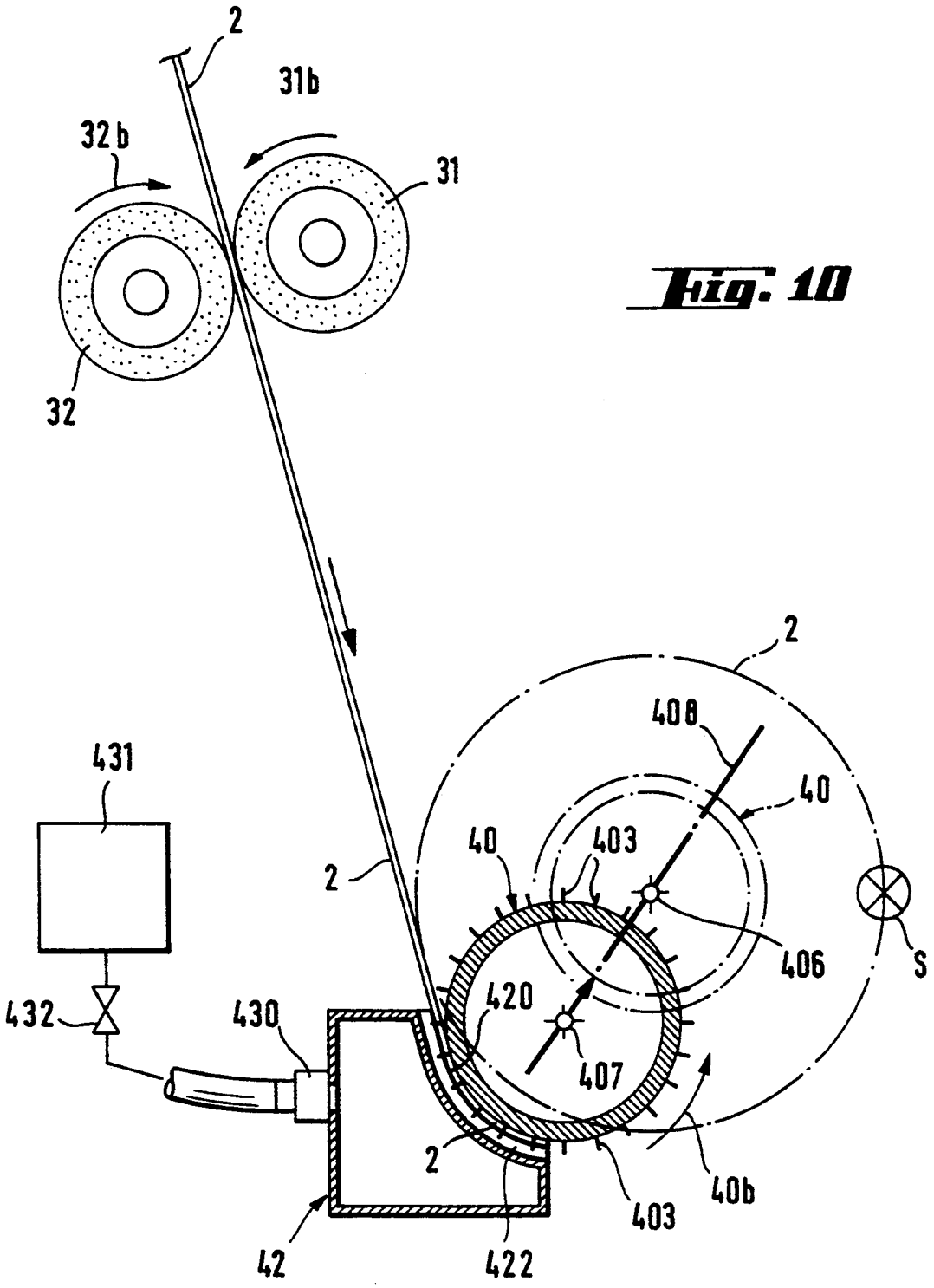
Figure 11:
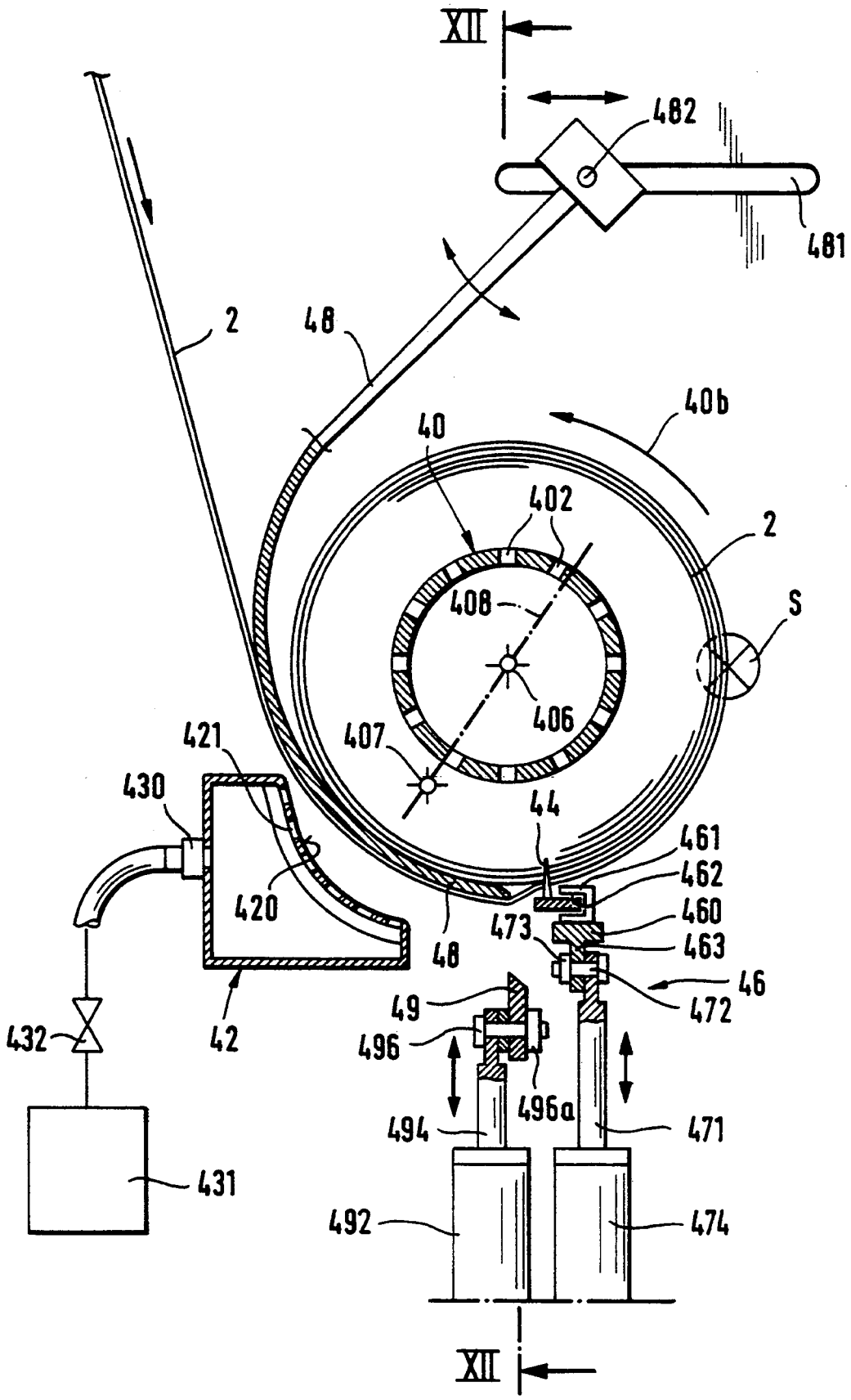
Figure 12:
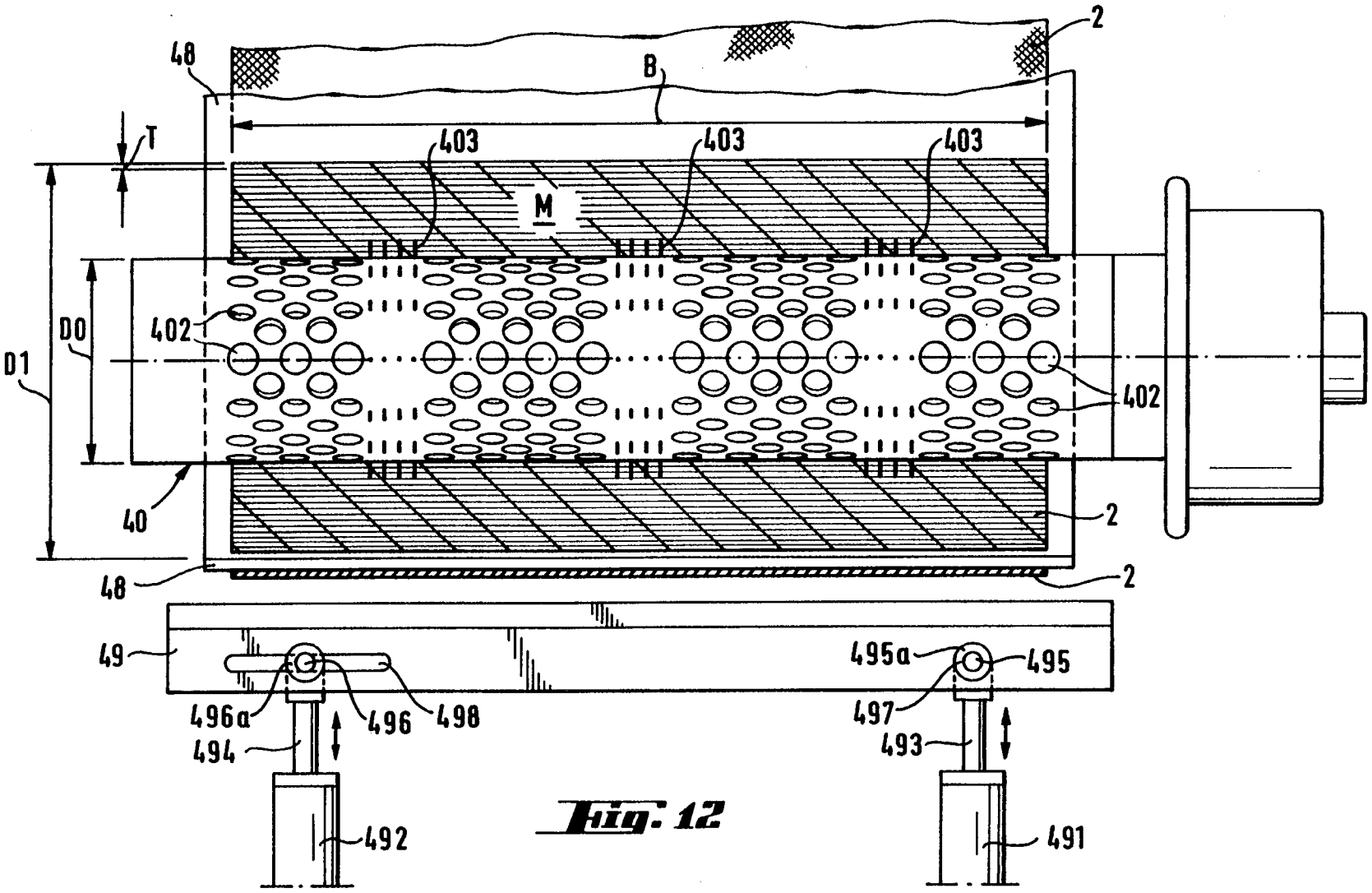

The invention is described in detail below with reference to the drawings, which are partly diagrammatical and/or in section:

FIG. 1 shows an embodiment of a laboratory dyeing line for sample dyeing,

FIG. 2 shows a basic arrangement with drives for transporting a substrate (for example a textile) from a substrate-storage reel to a substrate carrier and for winding the substrate onto that substrate carrier, FIG. 3 shows the arrangement of FIG. 2, with the addition of a computer having an input console, and control means and regulating means for the drives, FIG. 4 shows an embodiment of a magazine-like arrangement of substrate-storage reels having a movable transport drive that can be coupled to the draw rollers, FIG. 5 shows an embodiment of the transport drive that can be coupled to the draw rollers, FIG. 6 shows an embodiment of means for threading the textile (substrate) and/or for winding the textile onto a substrate carrier in the form of a sleeve, FIG. 7 shows the sleeve from FIG. 6 with fixing spikes that have been pivoted into a fixing position, FIG. 8 shows the sleeve from FIG. 7 with the pivotable fixing spikes provided thereon (pivoted inwards and pivoted outwards) for fixing to the winding the end of the textile belonging to the winding, FIG. 9 shows an embodiment of the actuating member for pivoting the fixing spikes inwards and outwards, FIG. 10 is a view of the winding apparatus intended to illustrate the threading and winding positions of the sleeve, FIG. 11 is a view of an embodiment of the apparatus according to the invention having means for cutting the textile and having an actuating member for pivoting the fixing spikes inwards and outwards, and FIG. 12 shows an embodiment of the means for cutting the textile.

In the embodiment of a laboratory dyeing line 1 shown in FIG. 1, substrates to be treated, especially textiles 2, are unwound from storage reels 3 on which the textiles are made ready, and transported to a work station 4. In that work station 4 the textiles are wound onto substrate carriers, for example onto sample-dyeing sleeves. The laboratory dyeing line also comprises a storage container 5 for dyestuff powder that can be made into a solution in a metering station 6. In a dye bath 7, the laden sample-dyeing sleeve can then be exposed to the dyestuff mixture and the textiles can thus be dyed.

A basic arrangement comprising a drive 300 for transporting the textile 2 from the storage reel 3 to a sample-dyeing sleeve 40 and a drive 400 for winding the textile 2 onto the sleeve 40 is shown in FIG. 2. The arrangement shown here also comprises draw rollers 31 and 32 clamped between which the textile 2 is guided and which can be driven with the aid of the drive 300. A simple version of such a drive 300 comprises a motor the drive shaft of which can be coupled to the draw roller 31, as indicated symbolically by the arrow 31*a*. The draw roller 32 can equally well be driven instead of the draw roller 31, as is shown symbolically by the arrow 32*a*. The draw rollers then rotate in the direction of the arrows 31*b* and 32*b*, respectively. Once the textile 2 has been threaded around the sleeve 40 (the threading operation is explained in detail below), the drive 400, which, as indicated by the arrow 40*a*, can be coupled to the sleeve 40, can be used to wind the textile 2 onto the sleeve 40 which during the winding operation rotates in the direction of the arrow 40*b*. The drive 400 may likewise simply comprise a motor the drive shaft of which can be coupled to the sleeve 40.

FIG. 3 shows the basic arrangement of FIG. 2, but with the addition of a computer 41 having an input console 41*a*. The inputs that can be made with the aid of the input console 41*a* will be discussed again in more detail later. Furthermore, as compared with the arrangement from FIG. 2, the arrangement additionally has regulating means 310 for the drive 300 of the draw rollers 31 and 32 and control means 410 for the drive 400 of the sleeve 40. Since the textile 2 is to be wound onto the sleeve 40 under uniform tension, the drive 400 drives the sleeve 40 at a uniform torque. The control means 410 are provided to ensure that this torque is uniform; they control the drive 400 of the sleeve 40 in dependence on the instantaneous rate at which the textile 2 is being transported to the sleeve 40. If the tensioning of the textile 2 is uniform the angular velocity of the sleeve 40 must naturally be greater at the start of the winding operation than it is towards the end of the winding operation, since the diameter of the winding on the sleeve 40 increases constantly. That presupposes a uniform feed rate of the textile 2 to the sleeve 40. If the thickness of the textile to be wound on is known to the computer 41, it calculates in dependence on the instantaneous feed rate a signal for the control means 410 which then control the drive 400 for the sleeve in such a manner that the textile 2 is wound onto the sleeve 40 under uniform tension. In order to keep the calculation effort to a minimum, regulating means 310 are also provided that regulate the drive 300 for the draw rollers 31 and 32 in such a manner that the textile 2 is transported to the sleeve 40 at a uniform feed rate. For that purpose the rate at which the textile 2 is transported must be monitored; many possible methods are conceivable. For example, the angular velocity of the transport rollers 31 and 32 can be monitored by sensors. That possibility is indicated symbolically by the dotted line 311 in FIG. 3. Other monitoring methods are of course equally possible. On the basis of the instantaneous feed rate of the textile 2 the computer 41 then calculates the particular instantaneous signal for the control means 410, which control the drive 400 accordingly. In that way it is ensured that the textile 2 is wound around the sleeve 40 under uniform tension. At the same time the computer also calculates a signal for the regulating means 310, which regulate the drive 300 for the draw rollers 31 and 32 in such a manner that the textile 2 is transported to the sleeve 40 at a uniform feed rate, thus reducing the effort required for the calculation.

In contrast to the descriptions given hitherto of a more general nature, there now follows a description of a possible embodiment of the winding apparatus, with reference to FIGS. 4 to 12. For that purpose a number of storage reels 3 can be provided, of which three are shown in FIG. 4. Provided for each of the storage reels is a separate pair of draw rollers 31 and 32, clamped between which rollers the textile 2 is guided. The end of the textile 2 is held on a retaining rail 42 in the manner shown in FIG. 6; it is, of course, possible for individual retaining elements 42 to be provided instead of the rail 42.

As already explained with reference to FIG. 4, the textile 2 is first held in the storage position. FIG. 6 shows the manner in which the textile 2 is held. Only the retaining element 42 or a corresponding retaining rail will be discussed here, although the sleeve 40 is also shown. The retaining element or the retaining rail 42 has a curved retaining surface 420 in which suction openings 421 are provided. Reduced pressure generated through the suction openings 421 in that retaining surface 420 causes the textile 2 to be drawn against the curved retaining surface 420, and held there, by suction. That reduced pressure is in this case generated with the aid of a reduced pressure source 431 connected by way of a valve 432, for example a controllable valve, and by way of the connection 430, to the retaining element 42. In addition, grooves 422 have been made in the retaining element 42 or in the retaining surface 420; the function of those grooves will be discussed in more detail later in the description of the threading operation.

Using the input console 41*a* (FIG. 3) it is then possible, for example, to select the desired textile 2 to be wound on. On the basis of that input, the drive 300 for the draw rollers 31 and 32 moves towards the corresponding storage reel 3 or towards the draw rollers 31 and 32 thereof (FIG. 4) and couples the drive to the draw rollers. For that purpose the drive 300 first moves along the rail 43 towards the selected storage reel 3 before, in order to effect coupling, moving its drive head 301 into axial alignment with the shaft of the draw roller to be driven (i.e. in FIG. 4 into the plane of the drawing) and then coupling it to the shaft of the corresponding draw roller, in this case to the shaft of the draw roller 31. Advantageously, the drive 400, together with the winding sleeve 40, is also connected to the movable drive 300 to form a structural unit, which allows the drives to be moved together to the particular selected storage reel 3, and as a result virtually a whole working step (the approaching of a possible drive together with the sleeve 40) can be saved.

The axial coupling of the drive 300 to the shaft of the draw roller 31 (FIG. 4) can be carried out, for example, in the manner shown in FIG. 5. For that purpose the drive head 301 is moved with the aid of a fast servomotor 302 by way of a pinion 303 driven by that servomotor 302 and a rack 304 which is engaged by the pinion 303, towards the shaft of the draw roller 31, i.e. in FIG. 5 towards the left. When the drive head 301 has been coupled to the shaft of the draw roller 31 (a possible method of coupling is indicated symbolically in FIG. 5 by the hexagon on the shaft and the associated blind hexagonal socket in the drive head 301), the drive motor 305 is able to rotate the drive head 301 and with it the draw roller 31. The driving of the drive head 301 and the associated rotation of the draw roller 31 can likewise be effected via an inter-engaging toothing (gearwheels, pinion).

In order for the threading operation and the subsequent winding operation to be better understood, there follows initially a description of the form the sleeve 40 in the embodiment described can take. To that end, each of FIGS. 7 and 8 shows such a sleeve 40, the sleeve 40 in the two Figures being already laden with textile 2. The Figures show that openings 402 are provided in the wall of the sleeve 40. The sleeve 40 shown in this case is therefore suitable for subsequent dyeing of the wound-on textile in a dye bath, since the dyeing fluid can easily pass through the openings 402 and through the wound-on textile 2, and in this way especially circulation of the dyeing fluid is possible. In addition, the sleeve 40 has on its outside, on its wall, needles 403 that project substantially radially from the outer wall. The function of those needles 403 will be discussed in more detail in the description of the threading operation.

It may also be seen from FIG. 7 and from FIG. 8 that the sleeve 40 further comprises fixing spikes 44 that are pivotable about a pin 450. The pin 450 itself is provided on the outside of a ring 45 which is arranged at the sleeve. The inner surface of the ring 45 is provided with a circumferential groove 451 in which the sleeve 40 is able to rotate freely during the winding operation, since the ring 45, together with the fixing spikes 44, is held in place once the fixing spikes 44 have been pivoted outwards. The manner in which the fixing spikes 44 are pivoted outwards will be explained in more detail later.

The fact that the fixing spikes 44 are pivotable about the pin 450 on the ring 45 can be seen especially well from FIG. 8. In that Figure, the fixing spikes 44 are shown in two different positions: in the pivoted-inwards state (fixing position, shown by the dotted line), into which they are pivoted before and after the loading of the sleeve 40, and in a pivoted-outwards position, in this case pivoted outwards 90° relative to the fixing position. Before the threading operation can be started, the fixing spikes 44 are first held in the fixing position (dotted line), for example by means of small springs (for example small flat spiral springs or leaf springs) which, for draughting reasons, are not shown. Then, in a manner that will be described later, they are pivoted out of that fixing position into a winding position in which they do not inhibit the loading of the sleeve 40 as they do in the fixing position. The fixing spikes 44 pivoted outwards 90° that are shown in FIG. 8 are intended merely to indicate that the fixing spikes 44 can be pivoted outwards to a sufficient extent that they do not inhibit the loading of the sleeve 40. In practice, a smaller pivoting may be quite adequate, as will be explained below. When the textile 2 has been threaded and wound onto the sleeve 40, the fixing spikes 44 are pivoted back into the fixing position. They then pierce at least the outer two layers of the textile 2 and thus fix it to the winding.

Before the threading and winding of the textile 2 can actually begin, the fixing spikes 44 (FIG. 7, FIG. 8) with which the sleeve 40 is provided must first be pivoted out of the fixing position so that the textile 2 can be threaded and/or the sleeve can be loaded without hindrance. Mention has already been made thereof above, but without any explanation of the manner in which that pivoting inwards and outwards can be effected.

The manner in which the fixing spikes 44 can be pivoted inwards and outwards is most evident from FIG. 9 and FIG. 11. In FIG. 11 the sleeve is again shown already laden with textile, whereas before the start of the threading operation no textile 2 has yet been wound around the sleeve or around the wail thereof. The fixing spikes 44 are at that time in the fixing position (FIG. 7, FIG. 8) as already explained above. Since at that time the fixing spikes 44 are not yet held in place, the ring 45 on which the pin 450 is provided rotates with the sleeve, together with the fixing spikes 44. The sleeve 40 is rotated in the direction of the arrow 40*b* (in the winding direction) until the fixing spikes 44 are brought into engagement with an actuating member 46. The actuating member 46 comprises a spar or beam 460 on which several substantially U-shaped retaining stop members 461 are formed, or the latter are connected to the spar 460. That has already been indicated in FIG. 11 and will be explained in more detail with reference to FIG. 9. The opening 462 in the retaining stop members 461 faces approximately at a tangent to the direction of rotation of the sleeve 40, with the result that as the sleeve rotates in the winding direction, i.e. in the direction of the arrow 40*b* (in this case anti-clockwise), the fixing spikes 44 are able to slide into the retaining stop members 461.

FIG. 9 shows how the fixing spikes 44 have already slid into the retaining stop members 461. Also clearly shown here is the manner in which the openings 462 in the stop members 461 are arranged to face approximately at a tangent to the direction of rotation of the sleeve 40 (upper position, fixing position). In this embodiment the spar 460 is provided with three such stop members 461 the openings 462 in which in this case face out of the plane of the drawing. Further rotation of the sleeve 40 merely causes the fixing spikes 44 to be pressed against the stop members 461. As a result, the ring 45, on which is provided the pin 450 on which the fixing spikes 44 are pivotally mounted, is no longer able to rotate with the sleeve 40. As already described with reference to FIG. 7 and FIG. 8, the sleeve 40 is then able to rotate freely in the groove 451 in the inner surface of the ring 45.

In order then to enable the textile 2 to be threaded and wound around the sleeve 40, the fixing spikes 44 must be pivoted out of the fixing position (upper position in FIG. 9). A possible method of pivoting the fixing spikes 44 out of that fixing position and into a winding position in which they do not inhibit the threading and winding operation is shown in FIG. 9. Provided on the bottom of the spar 460 is a guide sheet 463 in which a longitudinal opening 464 has been made. Projecting through the opening 464 is a pin 472 which is connected to a piston rod 471. In order to prevent the pin 472 from sliding out of the longitudinal opening 464, for example, a set collar 473 is provided on each side of the longitudinal opening 464 (FIG. 11). The piston rod 471 can be moved up and down with the aid of a piston drive 474 which can be operated, for example, hydraulically or pneumatically and is preferably electrically controllable. When the fixing spikes have slid into the retaining stop members 461 (upper position shown by dotted line, fixing position), the piston drive 474 moves the piston rod 471 downwards. This causes the spar 460 to move downwards at the same time, the pin 472 being able to slide along the longitudinal opening 464 in the guide sheet 463. When the fixing spikes 44 have been pivoted outwards in that manner into a winding position, as indicated in FIG. 9, the threading and then the winding operation can begin. At this point it should be noted that it is not necessary to pivot the fixing spikes 44 out of the fixing position by 90° as indicated in FIG. 8. That was intended merely to show that the fixing spikes 44 are capable of being pivoted outwards from the fixing position, and that they can be pivoted sufficiently far that they do not inhibit the threading and/or the winding of the textile 2 onto the sleeve 40. When the sleeve 40 has been loaded, the piston drive 474 moves the piston rod 471 upwards again until the fixing spikes 44 pierce the textile 2 so that it is fixed (FIG. 7). When the textile 2 has been cut, the sleeve is then rotated a short way counter to the winding direction of rotation, i.e. counter to the direction of the arrow 40*b* (i.e. in this case clockwise), allowing the fixing spikes 44 to slide back out of the openings 462 in the stop members 461.

In order to clarify the threading and winding operation, FIG. 10 once more shows the textile 2, guided clamped between the draw rollers 31 and 32, held in the storage position (FIG. 4). The reduced pressure generated through the suction openings 421 (FIG. 6) draws the textile 2 against the curved retaining surface 420 of the retaining element 42, and holds it against that surface, by means of suction. The sleeve 40 is arranged first of all in the winding position, which is indicated by the axis of rotation 406. With the sleeve 40 in that position, the fixing spikes 44 are pivoted outwards from the fixing position into the winding position in the manner described. The sleeve 40 is then moved into the threading position (axis of rotation 407). Provided in several regions around the outer wall of the sleeve 40 are needles 403 that project radially outwards from the outer wall. Those needles 403 are indicated in FIG. 10. As can be seen from FIG. 6, FIG. 7 and FIG. 8 (and as indicated in FIG. 10), the needles 403 engage the textile 2 to be threaded, i.e. they pierce it. In the regions in which the needles 403 pierce the textile 2, grooves 422 have been made in the retaining surface 420 of the retaining element 42. In FIG. 6, in which the sleeve is shown in the threading position, three such grooves 422 are shown by way of example. When the needles 403 have pierced the textile 2 and are in engagement with the textile 2, the reduced pressure source 431 is cut off in pressure from the retaining element 42, for example with the aid of the controllable valve 432. The sleeve is then rotated, for example, two complete turns about its axis of rotation 407 in the winding direction (i.e. in this case anti-clockwise). Along the grooves 422 in the retaining surface 420 the needles 403 can be rotated with the sleeve 40 and engage the textile 2 without being inhibited by the retaining element 42 or by its retaining surface 420. After that threading operation the textile 2 is sufficiently securely threaded around the sleeve 40 and, for further loading, the sleeve 40 is moved into the winding position (axis of rotation 406, FIG. 10), for example on a rail provided for the purpose that is indicated by the line 408 in FIG. 10. When the threading operation has taken place in that manner and the sleeve 40 has been moved into the winding position, there begins the actual winding operation in which the textile 2 is then wound onto the sleeve 40. When the sensor S, which is preferably arranged to be displaceable, detects a total diameter of the sleeve 40 and the wound-on textile 2, it transmits a corresponding signal to the control means 410 for the drive 400 (FIG. 3), which means stop the winding operation by switching off both the drive 400 for the sleeve 40 and the drive 300 for the draw rollers 31 and 32.

When the winding operation is finished, the fixing spikes 44 are moved in the manner already described into the fixing position in which they pierce at least the outer two layers of the textile 2 and thus fix it to the winding. The textile 2 then has to be cut. In order to prevent the cut end of the textile 2 that is not fixed to the winding from rolling up or from moving into a position in which it cannot subsequently be wound automatically onto the next sleeve 40 to be loaded, in accordance with FIG. 10 first of all the controllable valve 432 is actuated, with the result that the reduced pressure source 431 is again connected in pressure via the connection 430 to the retaining element 42 and generates reduced pressure through the openings 421 (FIG. 6) in the retaining surface 420 and draws the textile 2 against the retaining surface 420 by means of suction. The textile is then back in the defined storage position, described initially with reference to FIG. 4, in which automatic threading of the textile 2 can take place when the next sleeve of that textile is to be loaded.

The textile can be cut, for example, as described below with reference to FIG. 11 and FIG. 12. When the winding operation is finished and the textile 2 is held in the storage position against the retaining surface 420, a cuffing sheet 48 is pivoted between the strip of textile held against the retaining surface 420 and the textile wound onto the sleeve 40, i.e. between the strip of textile held in the storage position and the winding. The cutting sheet 48 acts as one blade of a pair of scissors, as described in more detail below with reference to FIG. 12. The pivoting of the cutting sheet can conceivably be effected in a variety of ways; in FIG. 11 the possibility of pivoting is indicated only symbolically by the slot 481 and the shaft 482 about which the cutting sheet 48 is mounted to pivot. When the cutting sheet 48 has been pivoted in, a further cutting sheet 49, which acts as the second blade of a pair of scissors, is moved against the cutting sheet 48 and thus cuts through the textile. That will be explained in more detail below with reference to FIG. 12.

In FIG. 12, which shows a section along the line XII—XII in FIG. 11, for the sake of simplicity only the sleeve 40 laden with textile 2 and the two cutting sheets 48 and 49, which act as the two blades of a pair of scissors, are shown. The layer of textile 2 lying on the outside of the cutting sheet 48 can also be seen. In order to cut through that layer, the cuffing sheet 48 (one blade of the "scissors"), after being pivoted in, is held fixed in position while the other cutting sheet 49 (the other blade of the "scissors") is moved like the second blade of a pair of scissors. That can be effected as shown in FIG. 12, for example with the aid of two piston drives 491 and 492 and their piston rods 493 and 494. Connected to and projecting from each of the piston rods 493 and 494 is a pin 495 and 496, respectively, each of the pins 495 and 496 projecting through an opening 497 and 498, respectively, in the cutting sheet 49 and, similarly to the actuating member for pivoting outwards the fixing spikes 44 (FIG. 9), being secured against sliding sideways out of their respective openings 497 and 498 by means of set collars 495*a* and 496*a* (FIG. 11, FIG. 12).

During the cutting operation, first of all the piston drive 491 moves the piston rod 493 upwards until the upper edge of the cutting sheet 49 reaches approximately the level of the lower edge of the cutting sheet 48, i.e. approximately as far as the level of the other blade of the "scissors". The other piston rod 494 remains initially in the position shown in FIG. 12. Since the pin 495 on the piston rod 493 and the cutting sheet 49 are unable to move relative to one another in a longitudinal direction because the opening 497 through which the pin 495 projects is only in the form of a through-hole, the cutting sheet 49 is moved a short distance relative to the pin 496 on the piston rod, to the fight according to the view in FIG. 12. That movement of the cutting sheet 49 is possible since the opening 498 through which the pin 496 on the piston rod 494 projects is in the form of a longitudinal opening in which the pin 496 can slide. When the upper edge of the cutting sheet 49 on the side of the piston drive 491 has reached approximately the level of the lower edge of the cutting sheet 48, the piston rod 493 remains in that position. The piston drive 492 then moves the piston rod 494 with the pin 496 upwards until the upper edge of the cutting sheet 49 on the side of the piston rod 494 reaches the same level as on the side of the piston rod 493. At the same time the cutting sheet 49 slides on pin 496 a little to the left again in the longitudinal opening 498 in accordance with the view in FIG. 12, so that at the end of the movement it is in approximately the same position relative to the longitudinal opening 498 as at the start of the movement of the piston rod 493. The described manner in which the cutting sheet 49 moves in the direction towards the cutting sheet 48 results in the upper edge of the cutting sheet 49 cutting through the textile 2 gradually along a cutting line, like the blade of a pair of scissors, from right to left in FIG. 12. When the textile 2 has been cut in that manner, the piston drives 491 and 492 move the cutting sheet 49 in reverse sequence back into the starting position shown in FIG. 12. The other cutting sheet 48 can then be pivoted outwards again and the laden sleeve 40 can be moved away and, for example, supplied to a sample-dyeing bath. A fresh empty sleeve can then be introduced and the textile 2 can be threaded around that fresh sleeve, from the storage position, in the manner described hereinbefore.

Now that the threading, the pivoting inwards and outwards of the fixing spikes, and the winding and cutting of the textile have been described, a further aspect of the invention is to be discussed. In the vast majority of applications, it is desirable to wind a constantly uniform mass of textile under uniform tension onto the sleeve in order to be able in the subsequent sample dyeing in the dye bath to obtain a reliable assessment of the resultant perceived colour. The mass per unit area of the textiles to be wound is often unknown. Even if the manufacturer of the textile has indicated the mass per unit area of the textile, a calibration must nevertheless be carried out in order to ensure that it will be possible always to wind a uniform mass of textile onto the sleeves. In other words, the actual mass per unit area of the textile to be wound on has to be determined for a storage reel, so that a large number of winding operations can then be carried out and a uniform mass of substrate will always be wound on. The width and the thickness of the textiles on the storage reels are known.

The calibration can be effected as follows: first the empty weight of a sleeve to be loaded is determined, for example by weighing it on scales. The diameter of the empty sleeve is also known. The textile is then threaded and wound onto the sleeve in the manner described above. At this point reference should be made again to FIG. 10. In the winding position (axis of rotation 406), textile is wound on until the sensor S detects that the sleeve 40 laden with textile 2 has reached a previously determined total diameter. In accordance with that previously determined total diameter, the adjustable sensor S is arranged in a quite specific position. When the predetermined total diameter of the laden sleeve is reached, the textile is cut and the sleeve laden with textile is weighed. The difference between the weight of the laden sleeve and the empty sleeve corresponds to the total weight of substrate that has been wound onto the sleeve.

Thus all the parameters of the textile that are required for the calibration are available, namely the diameter D0 (FIG. 7) of the empty sleeve, the diameter D1 of the laden sleeve (FIG. 7) previously determined by the position of the sensor S, the width B (FIG. 12) and the thickness T (FIG. 12) of the textile, and the total mass M of the textile wound onto the sleeve. Using all those known parameters the mass per unit area of the textile can be determined from the following equation for the total diameter D1 of the laden sleeve:

$$D1=T+[(D0-T)^2+(4MT/\pi\mu B)]^{\frac{1}{2}}.$$

All the parameters in that equation are known, with the exception of the mass per unit area of the textile, in this case designated $\mu$, and the mass per unit area $\mu$ of the textile can therefore be determined from the equation. That is, of course, preferably effected using the computer 41 (FIG. 3). The calibration is thus complete and the mass per unit area of the textile is now known.

It is often desirable when carrying out a large number of successive winding operations to wind the same desired mass onto sleeves of the same type (i.e. having the same internal diameter and the same weight when empty) over and over again. Once the calibration has been carried out and the mass per unit area of the textile is known, this can be effected simply using the above-mentioned equation. The required total diameter can be calculated using the computer 41, and the sensor S that triggers the end of the winding operation by detecting the total diameter can be positioned in accordance with that calculation. The positioning of the sensor S is preferably also effected automatically. The corresponding signals for controlling and/or regulating the motor drives 300 and 400 are then generated.

In principle, it is also sufficient, when the mass per unit area of the textile to be wound on is known, for only the length of the textile to be wound on to be calculated in advance and for corresponding signals for controlling and/or regulating the drives to be generated. It is also possible for a desired mass of textile to be wound onto the sleeve in that manner. The mass per unit area of the textile can be determined in the manner already described.

For many applications it is also desirable for the textile to be wound onto the sleeve under a quite specific tension and/or for the duration of the winding operation to be fixed. Those desired inputs can be input using the input console 41*a* (FIG. 3). With known textiles, a suitable warning can then be given, for example if the tension selected is too great, so that the inputting user can reduce the desired tension until it is compatible with the textile to be wound. The same applies when the winding times selected are too low, which corresponds to the selection of excessively high winding rates. If the desired parameters are compatible with the particular textile that is to be wound, corresponding signals are generated for controlling and/or regulating the motor drives 300 and 400. As a first step, as already mentioned above in the description of FIG. 4, the input console 41*a* can also be used to select the desired substrate to be wound from a number of substrates, whereupon the drives 300 and 400 are moved towards the corresponding substrate-storage reel 3 and the drive 300 is coupled to the corresponding draw rollers 31 and 32.

What is claimed is:

1. A method for winding substrates that are capable of being wound onto a substrate carrier, said method comprising:

holding the substrate to be wound in a defined storage position;

moving the substrate carrier into a threading position;

engaging the substrate with the substrate carrier such that the substrate to be wound is automatically threaded around the substrate carrier;

moving the substrate carrier into a winding position in which the substrate can be wound around the substrate carrier;

determining the mass per unit area of the substrate to be wound from the known substrate width and the known substrate thickness;

specifying a desired mass of substrate to be wound onto the substrate carrier;

generating controlling signals for controlling and/or regulating a motor drive on the basis of the determined mass per unit area of the substrate and the specified desired mass of substrate to be wound onto the substrate carrier;

transporting the substrate to the substrate carrier by motor-driving the substrate with the motor drive at a regulatable rate of feed while the substrate carrier is motor-driven in a controllable manner at a uniform torque and in dependence on the feed rate at which the substrate is being transported to the substrate carrier, until the substrate is wound around the substrate carrier;

cutting the substrate; and fixing the end of the substrate belonging to the winding automatically around the substrate carrier while again holding the other end of the substrate in the defined storage position.

2. A method according to claim 1 wherein further comprising, prior to moving the substrate carrier, determining the weight of the empty substrate carrier of known diameter; and further, in the step of transporting the substrate to the substrate carrier, winding the substrate onto the substrate carrier until a predetermined diameter of the laden substrate carrier is reached;

monitoring the weight of the laden substrate carrier; and stopping the winding operation when a pre-calculated diameter of the laden substrate carrier is reached, said pre-calculated diameter determined on the basis of the weight and diameter of the empty substrate carrier and the known substrate width and substrate thickness.

3. A method according to claim 1, further comprising, in the step of transporting the substrate to the substrate carrier, specifying a desired tension under which the substrate is to be wound onto the substrate carrier;

specifying a desired duration of the winding operation; and generating signals for controlling and/or regulating the motor drives where the specified values are compatible with the substrate to be wound on the basis of those values.

4. A method according to claim 1, further comprising, before holding the substrate to be wound in a defined position, the steps of making ready a number of substrates; and selecting or identifying the desired substrate to be wound from or among the number of substrates.

5. An apparatus for winding substrates that are capable of being wound, especially textiles, onto a substrate carrier, for example a sample-dyeing sleeve, the winding apparatus comprising a substrate store for making ready the substrate and means for winding the readied substrate onto the substrate carrier, and having means for cutting and fixing to the winding the end of the substrate belonging to the winding, wherein there are provided retaining means for holding the substrate in a defined storage position and means for moving the substrate carrier into a threading position in which the substrate carrier engages the substrate to be threaded that is held in the defined storage position and threads it around the substrate carrier, wherein the means for moving the substrate carrier then move the latter, after the substrate has been threaded, into a winding position in which the winding means wind the threaded substrate onto the substrate carrier, the winding means comprising a motor-driven transport drive provided with means for regulating the feed rate at which the transport drive transports the substrate guided between a pair of draw rollers to the substrate carrier, wherein the means for winding the substrate also include a motor-driven drive for the substrate carrier and that drive the substrate carrier at a uniform torque, and wherein the retaining means holds the other end of the substrate in the defined storage position again, said retaining means including a retaining rail having a retaining surface, facing the substrate carrier when the substrate carrier has been moved into the threading position, that has suction openings and a reduced pressure connection that is connected via a valve to a source of reduced pressure that, as the substrate is threaded on, is connected in pressure to the retaining element, with the result that reduced pressure is generated through the suction openings in the retaining surface and the substrate is drawn against the retaining surface by means of suction; the outer wall of the substrate carrier has several regions about the substrate carrier longitudinal axis in which needles project substantially radially outwards from the outer wall which engage the substrate held in the storage position and for which corresponding grooves have been made in the retaining surface of the retaining element; and, when the threading operation is complete, the valve cuts off the reduced pressure source from the retaining element in pressure, thus releasing the substrate from the retaining surface and allowing the substrate to be wound on the substrate carrier.

6. An apparatus according to claim 5 wherein the regulating means for the transport drive regulate the feed rate of the substrate to a uniform rate.

7. An apparatus according to claim 5 wherein the cutting means, seen in the transport direction of the substrate, are arranged immediately downstream of the retaining element.

8. An apparatus according claim 5, wherein the means for fixing to the winding the end of the substrate belonging to the winding comprise a ring that is provided on an individual substrate carrier coaxially with the longitudinal axis of the substrate carrier, in the region of the end of the substrate carrier, and that is provided on its inner surface with a circumferential groove in which the substrate carrier can rotate freely during winding, there being provided on the outside of the ring and arranged substantially perpendicular to the longitudinal sectional plane through the substrate carrier a pin around which actuatable fixing spikes are mounted so as to pivot between two positions in such a manner that as the substrate is wound onto the substrate carrier the spikes are pivoted outwards into a winding position in which they do not inhibit the winding of the substrate onto the substrate carrier, and in a fixing position they are pivoted inwards substantially into the longitudinal direction of the substrate carrier and pierce at least the outer two layers of the wound-on substrate and thus fix them together.

9. An apparatus according to claim 8 wherein actuating members are provided which pivot the fixing spikes outwards into the winding position before the threading operation starts and pivot the fixing spikes inwards into the fixing position at the end of the winding operation.

10. An apparatus according to claim 5, wherein means are provided for determining a mass per unit area of the substrate, the substrate width and the substrate thickness being known; wherein there are also provided input means for specifying a desired mass of substrate to be wound onto the substrate carrier; and there are provided calculating means that on the basis of the determined mass per unit area of the substrate and the desired mass to be wound on generate corresponding signals for the control means for the drive of the substrate carrier and/or for the regulating means for the transport drive and pass the signals on to them.

11. An apparatus according to claim 10 wherein weighing means for determining the weight of the substrate carrier when empty and when laden are provided for determining the mass per unit area; wherein means for monitoring the diameter of the laden substrate carrier are provided which stop the winding operation when the diameter of the laden substrate carrier has reached a predetermined diameter, and wherein, where the diameter of the empty substrate carrier is known, the calculating means use all those values to calculate the mass per unit area of the substrate and on the basis of the desired mass of substrate to be wound on calculate the diameter of the laden substrate carrier in advance and so position the means for monitoring the diameter of the laden substrate carrier that when the pre-calculated diameter is reached they detect it and thus stop the winding operation.

12. An apparatus according to claim 10, wherein input means are provided for specifying the desired mass of substrate to be wound onto the substrate carrier, for specifying a desired tension of the substrate on the substrate carrier and for specifying a duration of a winding operation; and, where the specified values are compatible with the substrate to be wound on, electronic calculating means generate on the basis of those values corresponding control signals for the drive motors or their control means or regulating means respectively.

13. An apparatus according to claim 5, which comprises a plurality of substrate-storage reels, there being provided for each storage reel a separate motor-driven pair of draw rollers clamped between which the substrate is guided; and input means are provided for specifying a desired substrate to be wound onto the substrate carrier, and wherein on the basis of the desired substrate specified the motor transport drive moves towards the draw rollers of the substrate selected via the input means and couples the drive to the draw rollers of the selected substrate.

* * * * *